US005647567A

United States Patent [19]

Pugh, Jr. et al.

[11] Patent Number: 5,647,567

[45] Date of Patent: Jul. 15, 1997

[54] ANTENNA MOUNTING BRACKET

[76] Inventors: William A. Pugh, Jr., 203 Pamela; Rocky Longino, 901 Sycamore St., both of Mineola, Tex. 75773-1325

[21] Appl. No.: 399,837

[22] Filed: Mar. 7, 1995

[51] Int. Cl.[6] ..... H01Q 1/120

[52] U.S. Cl. ..... 248/237; 248/323; 343/882

[58] Field of Search ..... 248/237, 323, 248/58, 62, 74.1, 265; 343/880, 882; 52/27, 28, 38, 39

[56] References Cited

U.S. PATENT DOCUMENTS

| | | | |
|---|---|---|---|
| 1,147,944 | 7/1915 | Holdensen | 248/265 X |
| 2,625,353 | 1/1953 | Henry | 248/237 X |
| 2,636,703 | 4/1953 | Wallans | 248/58 |
| 2,681,195 | 6/1954 | Bradt et al. . | |
| 2,695,149 | 11/1954 | Chabot | 248/237 X |
| 2,929,593 | 3/1960 | Rosenwinkel . | |
| 3,094,303 | 6/1963 | Belger . | |
| 3,095,033 | 6/1963 | Polkosnik | 248/265 X |
| 4,181,284 | 1/1980 | Seppelfrick | 248/514 |
| 4,595,165 | 6/1986 | Klingensmith et al. | 248/539 |
| 4,605,333 | 8/1986 | Hovland et al. | 403/27 |
| 4,652,890 | 3/1987 | Crean | 343/882 |
| 4,687,168 | 8/1987 | Rupp | 343/882 X |
| 4,755,830 | 7/1988 | Plunk | 343/882 X |

FOREIGN PATENT DOCUMENTS

| | | | |
|---|---|---|---|
| 3715024 | 11/1988 | Germany | H01Q 1/120 |
| 62-23602 | 1/1987 | Japan | H01Q 1/120 |
| 64-47102 | 2/1989 | Japan | H01Q 1/120 |

*Primary Examiner*—Ramon O. Ramirez
*Assistant Examiner*—Derek J. Berger
*Attorney, Agent, or Firm*—Crutsinger & Booth

[57] ABSTRACT

An adjustable satellite antenna mounting bracket that reinforces the eaves of a building roof. The antenna mounting bracket has a telescoping support having a rigid tubular form. The telescoping support has a back plate on one end that is secured to the sidewall of the building adjacent to the eave of the building. On the other end of the telescoping support is a base mount plate having a generally rectangular form adapted for accepting the base of a satellite antenna. The base mount plate that protrudes past the outer edge of the eave to permit unobstructed reception of satellite signals. The telescoping support is braced by a brace. The brace cradles the telescoping support in normal conditions, but in the event of severe weather, the brace maintains the position of the support. An extension lock fixes the length of the telescoping support and acts to reinforce the eave.

19 Claims, 5 Drawing Sheets

ANTENNA MOUNTING BRACKET

TECHNICAL FIELD

This invention relates to a device for mounting a satellite antenna to the eave of a building.

BACKGROUND OF THE INVENTION

Increased satellite signal sensitivity in signal reception equipment has diminished the requisite size of antenna dishes to presently a mere eighteen inches in diameter. The steel poles planted in a concrete foundation required for seven-foot antenna dishes and the buried cables of yesterday are now obsolete. Because a smaller antenna profile translates into reduced wind and load stress, satellite antennae can now be mounted directly to a wall or roof of a typical residence.

It is important, however, that a satellite dish, whatever its size, have an unobstructed view of the sky in the direction of the location of a broadcasting satellite. In many areas of the globe, for example the United States, a satellite dish must presently have an unobstructed view to a southerly direction. To achieve this unobstructed southern exposure, the manufacturers' mounting recommendations for these small satellite dish systems are limited to three choices: strapped to a chimney; mounted on top of a pitched roof; or positioned adjacent the southern wall of a building. In any of these three positions, the building does not obstruct the reception of the satellite dish.

When the satellite antenna is mounted to a chimney, the appearance is unbecoming. The antenna generally juts out awkwardly and is exposed to soot and possibly intense heat. Additionally, many residential buildings do not have chimneys.

When the satellite antenna is mounted directly to the roof of a building, mounting holes must be drilled through the roofing material to a roof rafter. This presents the challenge of locating a suitable rafter. Also, a rafter provides a limited anchoring surface providing only two mounting points to secure the satellite mount to the rafter. A rafter is inadequate because a tenuously secured antenna tends to sway in high winds and storms, causing a slow but certain breakdown of the roof material under the antenna's base. Furthermore, the roofing material's capability to keep out the weather is compromised because the drilled holes promote roofing material deterioration and eventually can cause a leaking roof.

Of the three manufacturer recommended options, the preferable location for a satellite antenna is positioned adjacent the southern wall of the building. However, in warmer climates, the southern wall of a building is preferably protected from direct sunlight by trees and shrubbery. Because an antenna must face a southerly exposure, an unobstructed view towards the satellite is typically defeated by the trees and shrubbery.

In view of the foregoing problems with the manufacturer mountings recommendations, the most logical choice for mounting a small satellite dish is to the eave of the building. The eave is elevated, and would permit the orientation of the dish over the roof of the building toward the southern sky. Unfortunately, a problem arises due to the inherent structural weakness of a typical household eave. Even the manufacturers of the small dish satellite antennae specifically advise users to avoid mounting the antenna on the eave of a house because of the eave's lack of rigidity. If the deficient rigidity could be overcome, an eave would be an ideal location because it allows an installer to avoid mounting the antenna to the chimney, directly to the roof, or on the obstructed southern wall of the building. The eave would provide almost any side of the building for unobstructed signal reception while simultaneously better blending the antenna with the building's profile.

SUMMARY OF THE INVENTION

Apparatuses and methods are provided for mounting a satellite antenna to a building having a roof with an eave.

To solve the problem of the inherent weakness of building eaves, a reinforcing antenna mount is provided. The satellite antenna mount has an adjustable telescoping support. The telescoping support includes a first telescoping member and a second telescoping member. A back plate is secured to an end of the telescoping support. The back plate is adapted to abut a seam formed by the sidewall and the eave of a building when the back plate is secured to the building. On the other end of the telescoping support is an antenna base mount plate. The base mount plate is adapted to accept the base of the satellite antenna. A brace secures the telescoping support to the eave of the building. The brace maintains the telescoping support in a generally horizontal position when the antenna is exposed to calm or severe weather. An extension lock sets the base mount plate in position.

In another aspect of the invention, a rod body portion extends from an end of the telescoping support. The rod body portion has a generally perpendicular bend relative to the telescoping support. The rod body portion can be secured to the sidewall of the building by metal "U" straps and bolts, thereby supporting the telescoping support in a generally horizontal position. The rod portion can be integral with the second telescoping member for added strength and durability of the support.

In yet another aspect of the invention, the base mount plate is detachably secured to the telescoping support. As the user of the satellite wishes to change satellite antennas, the satellite base mount plate can be simply replaced with one that fits the different satellite antenna, instead of installing a totally new antenna mount. A replaceable base mount plate consists of a base mount plate with a boss that is adapted to fit around a telescoping member. An aperture is formed through the boss to correspond with an aperture in the telescoping member. The telescoping member is inserted into the boss and the base mount plate is secured by a pin, bolt or other similar device.

The satellite antenna is secured to a building by the following method. The telescoping support is adjusted such that the base mount plate protrudes past the outer edge of the eave when the back plate contacts the sidewall of the building. The back plate is then secured by lag bolts or other similar devices to the sidewall such that the back plate abuts the seam formed between the sidewall and the building eave. The telescoping support is inserted into the collar of the brace. With respect to the eave, the brace is positioned and secured adjacent to the outer edge of the eave, causing the brace to sustain the telescoping support in a generally horizontal position. The satellite antenna is secured to the base mount plate. The antenna base mount plate is oriented to a vertical position by rotating a sleeve of the telescoping support. The vertical position of the base mount plate can be obtained by aligning a centerline mark on the antenna base with respect to a plumb bob serving as a vertical reference. At this point, the telescoping support is locked using an extension lock mounted on the exterior of the telescoping support. The extension lock has a member extending through the exterior to the interior member to frictionally engage the inner member, thereby fixing the length and maintaining the vertical position of the base mount plate. The installer may now proceed with final alignment and assembly instructions.

BRIEF DESCRIPTION OF THE DRAWINGS

The accompanying drawings are incorporated into and form a part of the specification to illustrate several examples of the present invention. These drawings together with the description serve to explain the principles of the invention. The drawings are only for the purpose of illustrating preferred and alternative examples of how the invention can be made and used and are not to be construed as limiting the invention to only the illustrated and described examples. The various advantages and features of the present invention will be apparent from a consideration of the drawing in which.

Other objects and advantages of the invention will become apparent upon reading the following detailed description and upon reference to the drawing, in which like reference characters are used throughout the various figures of the drawing to designate like parts.

DESCRIPTION OF THE PREFERRED EMBODIMENT

Figure 1:
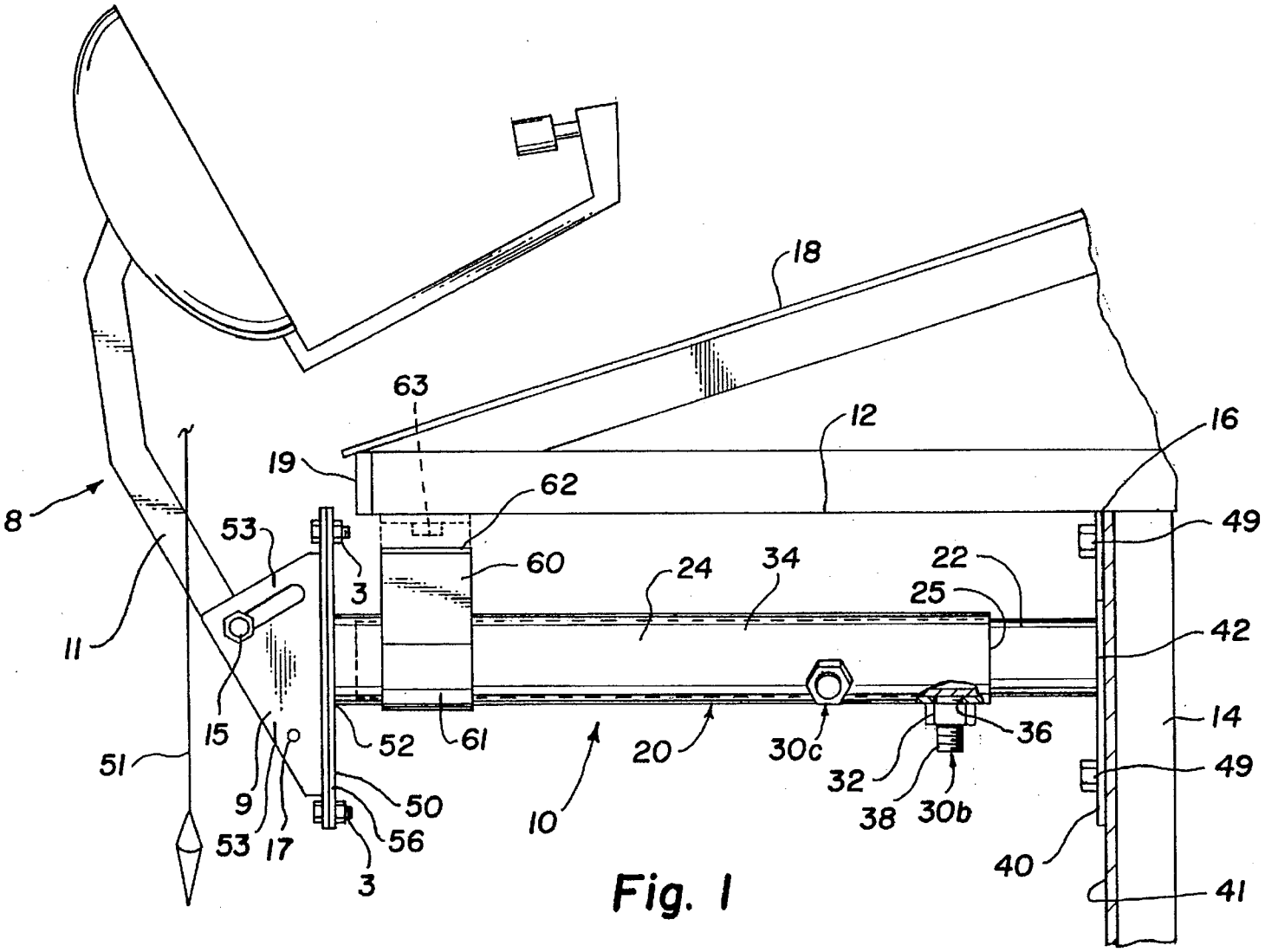
FIG. 1 is a side plan view of the antenna mounting bracket as mounted to a building with a satellite antenna installed.
Figure 2:
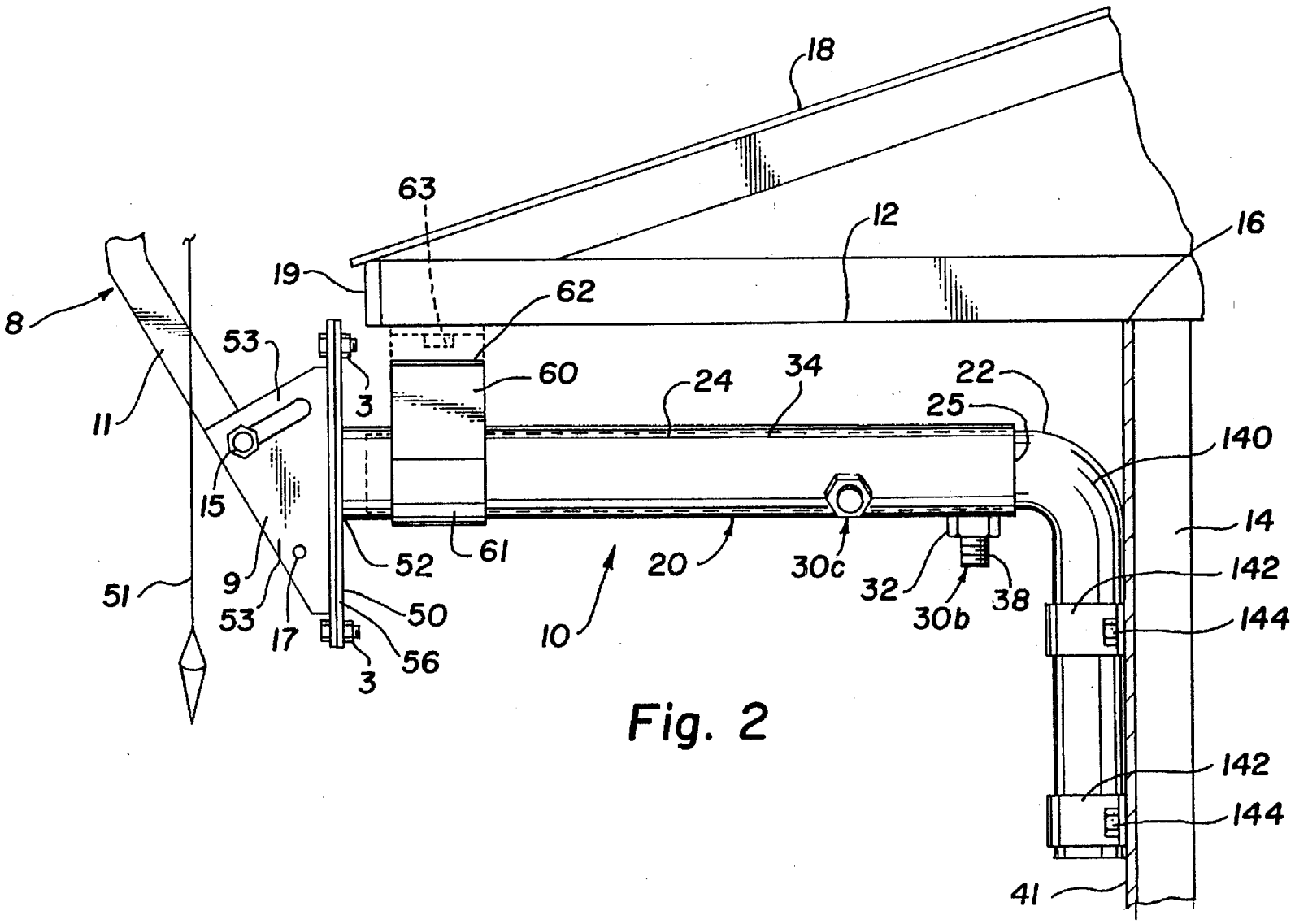
FIG. 2 is a side plan view of another embodiment of the antenna mounting bracket as mounted to a building with a satellite antenna installed.

Referring to FIG. 1 of the drawing, the numeral 10 generally designates an antenna mounting bracket which is preferably made of a rigid material such as painted steel. As shown in FIG. 1, a satellite antenna 8 is attached to the antenna mounting bracket 10 through an antenna base 9. The antenna mounting bracket 10 is comprised of a telescoping support 20, an extension lock 30, a back plate 40, a base mount plate 50, and a brace 60. Referring to FIGS. 1 and 2, the antenna mounting bracket 10 is secured to the underside of the eave 12 and the exterior surface 41 of the sidewall 14.

Figure 3:
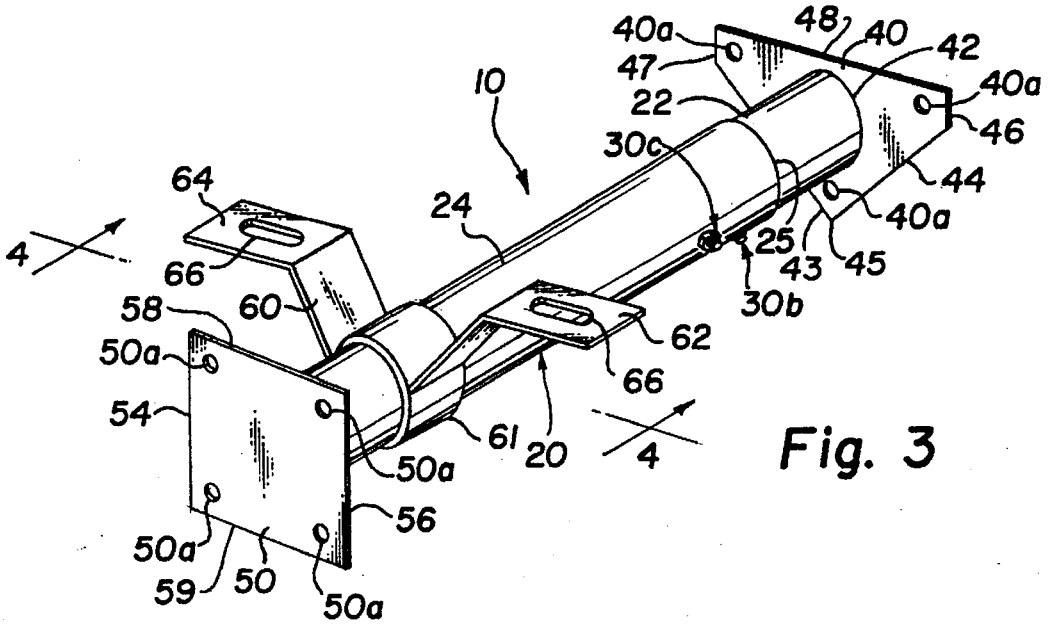
FIG. 3 is a perspective view of the antenna mounting bracket, the telescoping support illustrated as being partially extended.

Referring to FIGS. 1 and 3, the telescoping support 20 has a first telescoping member 24 with a larger diameter than a second telescoping member 22. The second telescoping member 22 is contained within the larger, or first, telescoping member 24, permitting the telescoping support 20 to have an adjustable length preferably from about fourteen inches to about twenty-seven inches. The second telescoping member 22 is preferably hollow due to weight considerations. Both telescoping members 22 and 24 can be of a rigid cylindrical form. As should be readily apparent to those skilled in the art, each of the telescoping members 22 and 24 can be physically shortened by cutting them with a metal saw to adapt the telescoping support 20 to narrower eaves 12.

Figure 5:
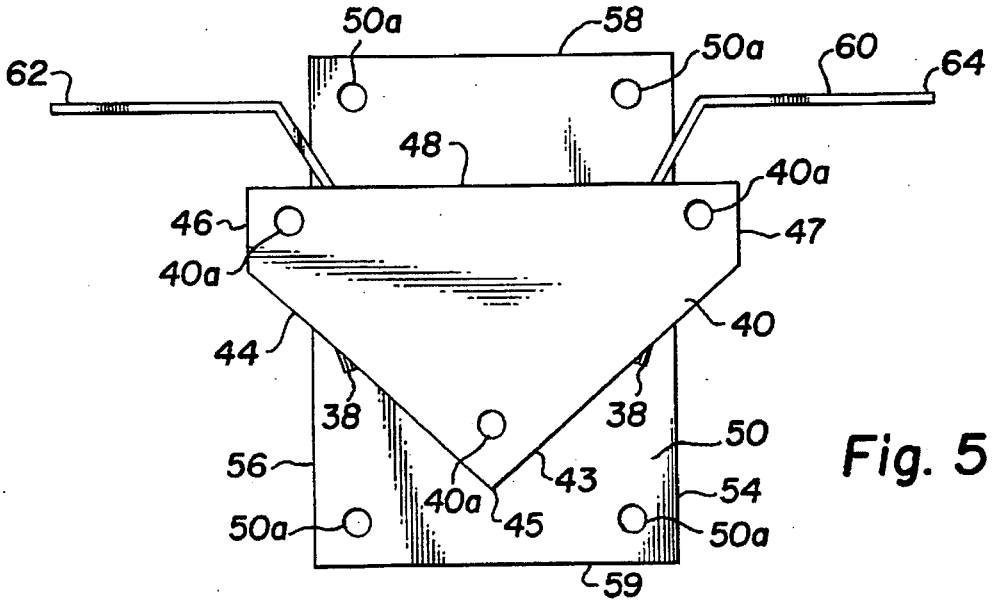
FIG. 5 is a plan view from the back plate.

Referring to FIG. 3, a flangular body portion such as the back plate 40, is centrally attached to a first end 42 of the telescoping support 20. The back plate 40 is perpendicular with respect to the telescoping support 20 such that the back plate 40 orients the telescoping support 20 in a generally horizontal position when the back plate 40 is secured to the sidewall of the building A suitable method of attaching the back plate 40 to the first end 42 is by a seam weld or similar adhesion method. The back plate 40 has a triangular profile having an extended rectangular base as best shown in FIG. 5. The triangular profile is formed by inclined edges 43 and 44 which originate at an apex point 45. The inclined edges 43 and 44 diverge from the apex point 45 until they meet a pair of vertical edges 46 and 47, respectively. The vertical edges 46 and 47 form an extended rectangle on the base of the triangular profile of the back plate 40. The vertical edges 46 and 47 extend to the upper edge 48 of the back plate 40.

The unique profile of the back plate 40 allows the inclined edges 43 and 44 of the back plate 40 to abut a corner seam formed by a gabled roof. Alternatively, the upper edge 48 of the back plate 40 can abut a straight seam 16 formed between the eave 12 and sidewall 14 as illustrated in FIG. 1. The back plate 40 is secured to the exterior surface 41 of the sidewall 14 through a plurality of apertures 40*a*. As shown in FIG. 1, lag bolts 49, screws, or other suitable installation means can be inserted through the apertures 40*a* to secure the back plate 40 to the exterior surface 41 of the sidewall 14.

In another embodiment of the invention, as shown in FIG. 2, the back plate 40 can be replaced with a rod body portion 140 that extends sufficiently perpendicular with respect to the telescoping support 20. That is, the rod body portion 140 orients the telescoping support 20 in a generally horizontal position when the rod body portion 140 is secured to the sidewall of the building by metal "U" straps 142 and bolts 144, thereby supporting the telescoping support in a horizontal position. As should be readily apparent to those skilled in the art, the rod body portion can be a hollow member inserted into the second telescoping member 22 and secured by pinning or welding the hollow member to the telescoping member 22. Alternatively, telescoping member 22 and rod body portion 140 can comprise an integral member that is bent to form a generally perpendicular angle.

Referring to FIG. 1, a base mount plate 50 is secured to a second end surface 52 of the telescoping support 20. The base mount plate 50 is adapted to accept the base mount 9 of an 18" RCA DSS (Digital Satellite System) satellite antenna. The base mount plate 50 is of a planar rectangular form with a width preferably about five inches wide by a length preferably about seven inches. As best shown in FIG. 3, the base mount plate has side edge surfaces 54 and 56 bounded by a top edge surface 58 and a bottom edge surface 59. The satellite antenna base 9 can be secured to the base mounting plate 50 through apertures 50*a* with bolts and nuts 3 or other suitable means known to those skilled in the art.

Figure 6:
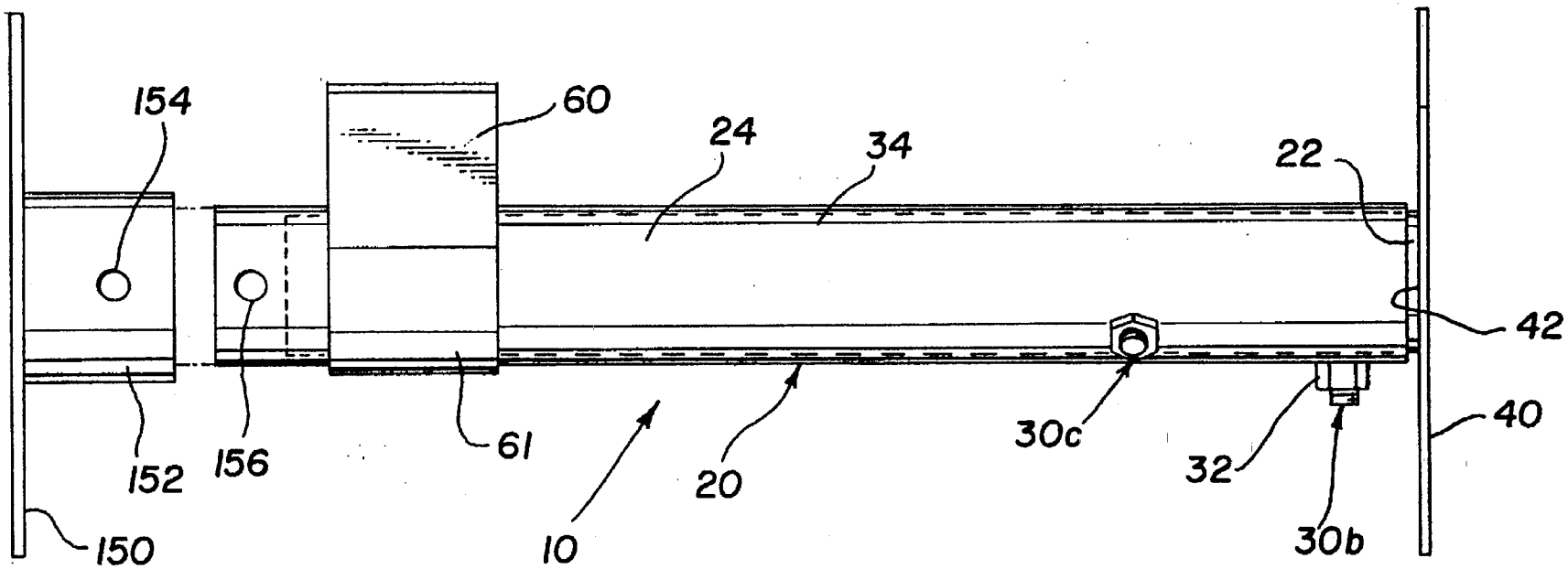
FIG. 6 is a side plan view of another embodiment of the antenna mounting bracket that employs a replaceable base mount plate.

In a further embodiment of the invention, the base mount plate 50 can be detachably secured to the telescoping support 20. A detachably secured base mount plate 150, shown in FIG. 6, allows differing antenna base configurations to be secured to the antenna mounting bracket 10. The base mount plate 150 has a boss 152 adapted to accept the end portion of the first telescoping member 24. A pair of apertures 154 are formed through the boss 152. The apertures 154 correspond with apertures 156 formed through the first telescoping member 24. The telescoping member 24 is inserted into the boss 152 and can be secured in place by a pin, bolt or other similar device as should be well known to those skilled in the art.

Figure 4:
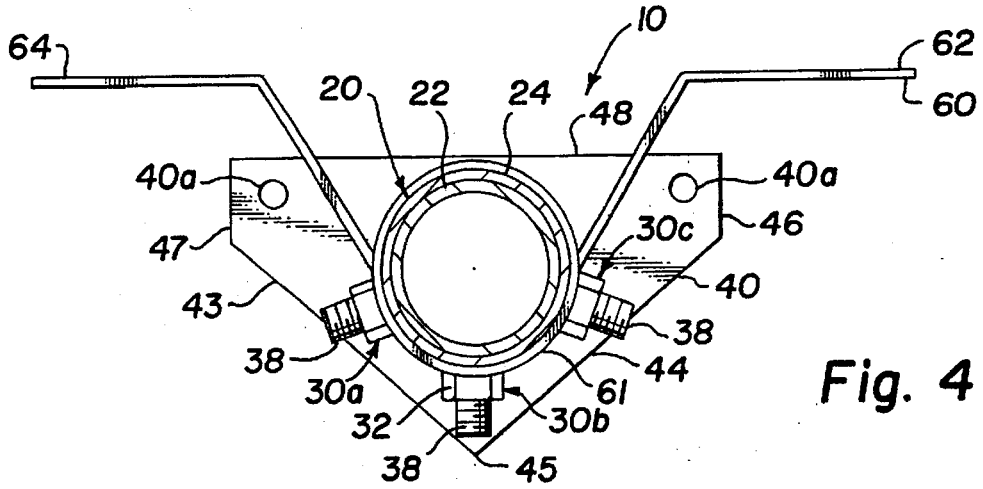
FIG. 4 is a cross-sectional view taken along line 4—4 of FIG. 3.

Referring to FIGS. 3–5, a brace 60 is shown with a first and second end 62 and 64, respectively. Best shown in FIG. 4, a collar portion 61 is generally centered between the first and second ends 62 and 64. The collar portion is adapted to accept the telescoping member 24 to cradle the telescoping support 20. In the event of severe weather or strong winds, the collar portion 61 acts to maintain the telescoping support 20 in a generally horizontal position. As shown in FIG. 1, the brace 60 is secured to the eave 12. Referring briefly to FIGS. 3 and 5, the first and second ends 62 and 64 are secured to the eave 12 by inserting screws 63, bolts or other similar mounting means through brace apertures 66 formed in the first and second ends 62 and 64, respectively.

Referring to FIG. 1, an extension lock, which is generally referred to by the numeral 30, locks the telescoping support 20 at a length wherein the base mount plate 50 extends past the gabled edge 19, as set by the user. The extension lock 30 is generally comprised of a threaded mount 32 secured to the outer surface 34 of the first telescoping member 24. The threaded mount 32 is preferably a threaded nut attached to the surface of the larger first telescoping member 24 by welding or other similar adhesion methods. As best shown in FIG. 1, the bore 36 of the threaded mount 32 extends through the first telescoping member 24 to communicate with an interior cavity of the first telescoping member 24. A set screw 38 can be threaded through the threaded mount 32 until it frictionally engages the surface of the second telescoping member 22 contained within the first telescoping member 24. The set screw 38 can be comprised of a bolt, an allen set screw, or similar apparatus well known to those skilled in the art.

Figure 7:
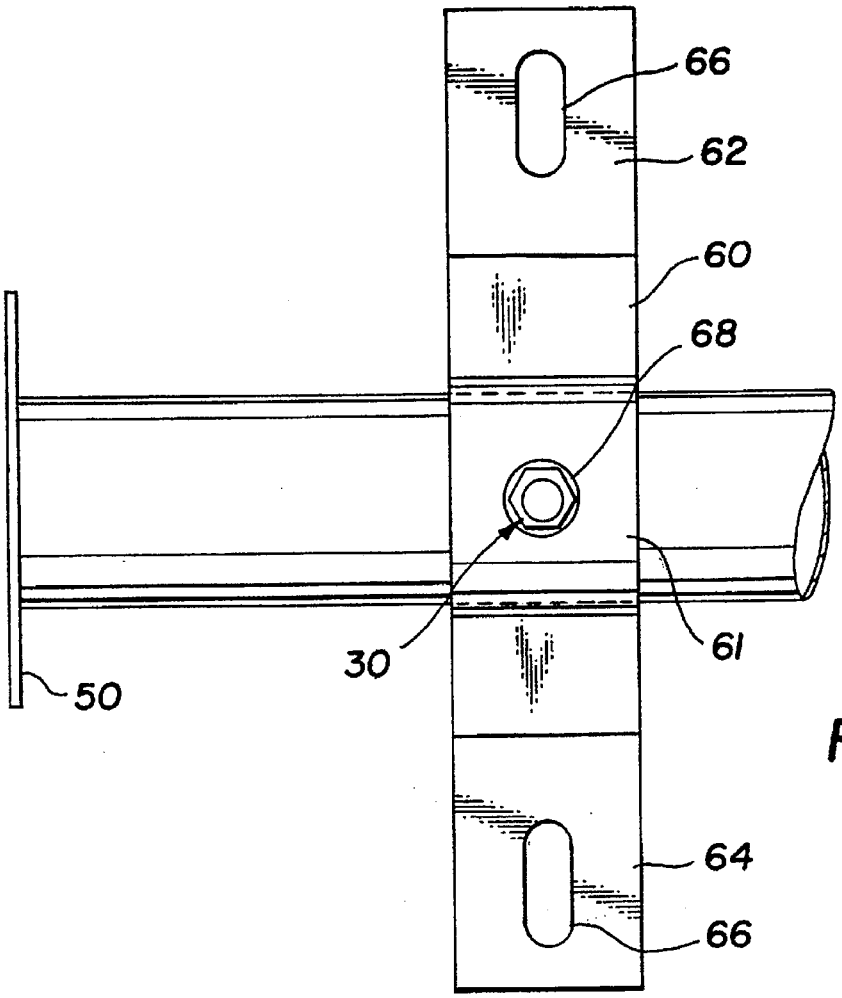
FIG. 7 is an enlarged bottom perspective view detailing a further embodiment of the brace with a collar aperture engaging an extension lock.

Referring to FIGS. 3 and 4, three extension locks 30 are mounted to the exterior surface of the larger first telescoping member 24. A first extension lock **30*b* is positioned adjacent the end 25 of the first telescoping member 24. A second extension lock 30*a* is positioned on a side of telescoping member 24 about thirty degrees from the first extension lock 30*b* and distal from the first extension lock 30*b*. A third extension lock 30*c* is positioned approximately opposite the second extension lock 30*a* by about sixty degrees. In another embodiment of the brace 60, as illustrated in FIG. 7, an extension lock 30 is positioned near the base mounting plate 50. The collar portion 61 has an aperture 68 adapted to accept and engage the outer surface of an extension lock 30. The extension lock 30 can be mounted to the telescoping member 24 through the collar aperture 68 by inserting the threaded mount 32, or a bolt, into a cavity 36 prepared with machined threads. The collar aperture 68 acts to further brace the telescoping support 20 by engaging the side of the threaded mount 32. Shifting of the telescoping support 20 relative to the brace 60 is further minimized when a weighted load is acting on to the base mount plate 50**.

Referring to FIG. 1, the antenna mounting bracket 10 is installed with the back plate 40 abutting the seam 16 formed by the sidewall 14 and the eave 12. The telescoping support 20 is extended such that the base mount plate 50 protrudes past the gabled edge 19 of the eave 12.

The back plate 40 is secured to the exterior surface 41 of the sidewall 14 with bolts, screws or similar devices inserted through apertures **40*a* into the sidewall 14. The back plate 40 should be oriented with the upper edge 48 (see FIG. 5) abutting the seam 16 formed by the junction of the sidewall 14 with the eave 12. If the roof 18 is a gabled roof, the apex point 45 (see FIG. 5) of the back plate 40 should be oriented to abut the corner seam 16 formed at the roof's ridgeline to take advantage of greater surface area contact between the seam 16 and the inclined edges 43 and 44 of the back plate 40**. If a discreet installation location is needed due to city ordinances or otherwise, the antenna mounting bracket can be mounted on any eave on any side of a building having a gabled or a horizontal roof.

As shown in FIG. 1, the brace 60 is secured to the eave 12 adjacent the gabled edge 19 of the eave 12 and across the telescoping support 20. The brace 60 is secured to the eave 12 by inserting a screw or similar device through the brace apertures 66 on opposing sides 62 and 64 (see FIG. 3) of the brace 60.

Referring to FIG. 1, the telescoping support 20 needs to be in a generally horizontal position. To adjust the horizontal orientation of the telescoping support 20, the ends 62 and 64 (shown in phantom lines) are urged towards or away relative to one another to alter the vertical displacement of the collar portion 61 of the brace 60, thereby allowing horizontal adjustment of the telescoping support 20. Horizontal references for alignment are readily obtained by methods that should be readily apparent to those skilled in the art.

The antenna base 9 is mounted to the base mount plate 50. Typically, a centerline mark 53, comprising an alignment mark at the top and another at the bottom of the antenna base, is stamped on the base 9 of the antenna 8 to aid in vertical alignment of the antenna. Generally, as is well known in the art, a vertical reference tool such as a plumb bob 51 can be used to adjust the base 50 and the attached antenna to a vertical position. To achieve a vertical position, the base mount plate 50 is rotated until the vertical reference point, supplied by the plumb bob 51, aligns with the centerline mark 53. Once in alignment, the base mount plate 50 is set by setting the extension locks 30 located on the telescoping support 20.

The telescoping support 20 reinforces an inherently weak building eave 12 by distributing the static load of the satellite antenna from the base mount plate 50 to the brace 60. A portion of the force exerted on the brace 60 is then transferred to the back plate 40 to the attached sidewall 14 of the building, serving to reinforce and bolster the eave 12. In calm weather the brace 60 cradles the telescoping support 20. In the event of severe weather, and the accompanying winds that act on the antenna 8, the collar portion 61 of the brace 60 acts to maintain the vertical position of the telescoping support 20.

Figure 8:
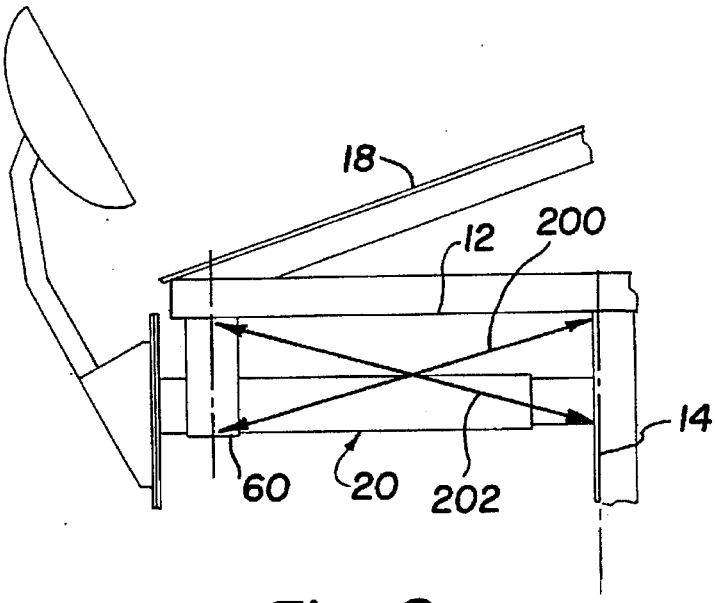
FIG. 8 is a static load diagram of the installed antenna mounting bracket.

The signal and power wires associated with the satellite antenna may be routed to the ground and into the attic of the building and connected to the antenna's receiver. A static load structure is generated as best shown in FIG. 8. The load of the mounted satellite antenna 8 is dispersed through a rectangular configuration generated by the brace 60, the eave 12, the sidewall 14 and the telescoping support 20. This configuration serves to reinforce the eave of the house, as shown by the load distribution vectors 200 and 202.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for mounting a satellite antenna with a base to a building with a sidewall and a roof having an eave, the apparatus comprising:

an adjustable telescoping support with a first end and a second end;

a flangular body portion perpendicular to said telescoping support secured to the first end of said telescoping support for mounting said telescoping support to the sidewall under and adjacent the eave of the building in a generally horizontal position;

an antenna mounting flange secured to the second end of said telescoping support, said antenna mounting flange having a plurality of apertures for securing the base of the antenna to the antenna mounting flange;

a brace for attaching said telescoping support to the eave and maintaining said telescoping support in a generally horizontal position adjacent to the eave of the roof; and a lock mounted on said telescoping support for setting a length of said telescoping support such that the antenna mounting flange extends at least to the outer edge of the eave.

2. The apparatus as recited in claim 1, wherein said telescoping support comprises:

a first rigid telescoping member; and a second rigid telescoping member with a diameter sufficiently less than a diameter of said first telescoping member such that said second telescoping member is contained within said first telescoping member whereby the length of said telescoping support can be adjusted by telescopically extending said second telescoping member from said first telescoping member.

3. The apparatus as recited in claim 1, wherein said flangular body portion further comprises:

a rod body portion extending sufficiently perpendicular from the first end of said telescoping support such that when said rod body portion is secured to the sidewall of the building the telescoping support is in a horizontal position.

4. The apparatus as recited in claim 3, wherein said rod body portion is integral with the first end of said telescoping support.

5. The apparatus as recited in claim 1, wherein said brace further comprises a collar portion positioned between a first brace end and a second brace end said collar portion adapted to accept said telescoping support.

6. The apparatus as recited in claim 1, wherein said antenna mounting flange is detachably secured to the second end of said telescoping support.

7. The apparatus as recited in claim 1, wherein said telescoping support extends from about 14 inches to about 27 inches.

8. The apparatus as recited in claim 1, wherein the apparatus is made of a painted steel.

9. The apparatus as recited in claim 1, wherein said flangular body portion comprises:

a back plate having a plurality of apertures for securing said back plate to the sidewall adjacent to the eave of the building.

10. Apparatus for mounting a satellite antenna with a base to a building having a sidewall and a roof with an eave, said apparatus comprising:

an adjustable telescoping support with a first end and a second end having a rigid tubular form with an outer and an inner cylinder, the inner cylinder having a diameter sufficiently less than a diameter of the outer cylinder such that the inner cylinder is contained within the outer cylinder whereby the length of said telescoping support can be adjusted by telescopically extending said inner cylinder from said outer cylinder;

a back plate perpendicular to said telescoping support secured to the first end of said telescoping support, said back plate having a rigid planar body with a plurality of apertures and an edge surface adapted to abut a seam formed by the sidewall and the eave for mounting said telescoping support to the sidewall under and adjacent to the eave of the building in a generally horizontal position;

a base mount plate secured to the second end of said telescoping support, said base mount plate having a rigid form adapted to accept the base of the satellite antenna and a plurality of apertures formed in the base mount plate for mounting the base of the satellite antenna thereto;

a brace with a collar portion positioned between a first brace end and a second brace end, said collar portion placed about said telescoping support for rigidly securing said telescoping support to the eave of the roof; and an extension lock mounted on said telescoping support for setting a fixed length of said telescoping support.

11. The apparatus as recited in claim 10, wherein said telescoping support extends from about 14 inches to about 27 inches.

12. The apparatus as recited in claim 10, wherein said base mount plate is made of a painted steel.

13. The apparatus as recited in claim 10, wherein said base mount plate is detachably secured to the second end of said telescoping support.

14. The apparatus as recited in claim 10, wherein the inner cylinder of said telescoping support is a hollow cylinder.

15. A method of mounting a satellite antenna to an eave of a building having a sidewall, the method comprising the steps of:

adjusting a length of a telescoping support having a base mount plate and a back plate perpendicular to the telescoping support such that said base mount plate protrudes past an outer edge of the eave when said back plate is adjacent the sidewall and the telescoping support is in a generally horizontal position;

securing said back plate to the sidewall and adjacent to the eave;

securing a brace placed about said telescoping support to the eave and adjacent to an outer edge of the eave;

mounting the satellite antenna to said base mount plate;

orienting said base mount plate to a vertical position; and locking the length of said telescoping support and the vertical position of the base mount plate.

16. The method of mounting the satellite antenna to the building as set forth in claim 15, wherein orienting said base mount plate to a vertical position is facilitated by aligning a centerline mark on the antenna with a plumb bob.

17. Apparatus for mounting a satellite antenna with a base to a building with a sidewall and a roof having an eave, the apparatus comprising:

an adjustable telescoping support with a first end and a second end;

a flangular body portion secured to the first end of said telescoping support for mounting said telescoping support to the sidewall under and adjacent the eave of the building, wherein said flangular body portion includes a back plate having a rigid, planar, triangular shape with an extended base, said back plate secured to the first end of said telescoping support, and a plurality of apertures for securing said back plate to the sidewall adjacent to the eave of the building;

an antenna mounting flange secured to the second end of said telescoping support, said antenna mounting flange adapted to accept the base of the satellite antenna;

a brace for attaching to said telescoping support and to the eave, thereby maintaining said telescoping support in a generally horizontal position adjacent to the eave of the roof; and a lock mounted on said telescoping support for setting a length of said telescoping support such that the antenna mounting flange extends at least to the outer edge of the eave.

18. Apparatus for mounting a satellite antenna with a base to a building with a sidewall and a roof having an eave, the apparatus comprising:

an adjustable telescoping support with a first end and a second end;

a flangular body portion perpendicular to said telescoping support secured to the first end of said telescoping support for mounting said telescoping support to the sidewall under and adjacent the eave of the building in a generally horizontal position;

an antenna mounting flange secured to the second end of said telescoping support, said antenna mounting flange having means for securing the base of the antenna to the antenna mounting flange;

a brace for attaching said telescoping support to the eave and maintaining said telescoping support in a generally horizontal position adjacent to the eave of the roof; and a lock mounted on said telescoping support for setting a length of said telescoping support such that the antenna mounting flange extends at least to the outer edge of the eave.

19. Apparatus for mounting a satellite antenna with a base to a building with a sidewall and a roof having an eave, the apparatus comprising:

an adjustable telescoping support with a first end and a second end;

a flangular body portion perpendicular to said telescoping support secured to the first end of said telescoping support for mounting said telescoping support to the sidewall under and adjacent the eave of the building in a generally horizontal position;

an antenna mounting flange secured to the second end of said telescoping support, said antenna mounting flange having a base mount plate having a planar rectangular body attached to the second end of said telescoping support, said base mount plate adapted to accept the base of the satellite antenna, and a plurality of apertures for securing the base of the satellite antenna to said base mount plate;

a brace for attaching said telescoping support to the eave and maintaining said telescoping support in a generally horizontal position adjacent to the eave of the roof; and a lock mounted on said telescoping support for setting a length of said telescoping support such that the antenna mounting flange extends at least to the outer edge of the eave.

* * * * *